US006389631B1

(12) United States Patent
Keith

(10) Patent No.: US 6,389,631 B1
(45) Date of Patent: May 21, 2002

(54) FOOT SCRUBBING DEVICE

(76) Inventor: Mark H. Keith, 264 Woodstock Ave., Avon Lake, OH (US) 44012

( * ) Notice: Subject to any disclaimer, the term of this patent is extended or adjusted under 35 U.S.C. 154(b) by 4 days.

(21) Appl. No.: 09/709,274

(22) Filed: Nov. 10, 2000

(51) Int. Cl.[7] ..... A47K 3/22
(52) U.S. Cl. ..... 15/104.92; 15/160
(58) Field of Search ..... 15/104.92, 160, 15/161; 4/606, 622, 574.1; 601/28

(56) References Cited

U.S. PATENT DOCUMENTS 3,548,439 A * 12/1970 Berst
3,973,286 A * 8/1976 Logan
4,417,362 A 11/1983 Walker
4,520,525 A 6/1985 Yogi
D283,847 S 5/1986 Miller
4,617,917 A 10/1986 Miller
5,163,200 A 11/1992 Carlin et al.
5,177,829 A 1/1993 Simpson
5,724,695 A * 3/1998 Galizia
5,729,858 A * 3/1998 Riffel
5,813,078 A * 9/1998 Hogan
5,983,433 A * 11/1999 Chapman
6,223,379 B1 * 5/2001 Martin
6,253,407 B1 * 7/2001 Bjelkevig

* cited by examiner

*Primary Examiner*—Terrence R. Till

(57) ABSTRACT

A foot scrubbing device for scrubbing and cleaning a user's feet in a bathtub or shower stall. The foot scrubbing device includes a foot support assembly including a foot support member having a top wall and a bottom wall, and also including a reservoir disposed between the top wall and the bottom wall with the reservoir being adapted to store soap and water therein; and also includes a band member having ends securely attached to sides of the foot support member and being disposed in the reservoir with the band member extending above the foot support member; and further includes a plurality of bristles being disposed upon the top wall of said foot support member and upon an underside of said band member; and also includes a plurality of fastening members being securely attached to an exterior of the bottom wall and being adapted to removably secure the foot scrubbing device to a surface such as a bathtub.

9 Claims, 5 Drawing Sheets

FOOT SCRUBBING DEVICE

BACKGROUND OF THE INVENTION

1. Field of the Invention

The present invention relates to a foot cleaner and more particularly pertains to a new foot scrubbing device for scrubbing and cleaning a user's feet in a bathtub or shower stall.

2. Description of the Prior Art

The use of a foot cleaner is known in the prior art. More specifically, a foot cleaner heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,177,829; U.S. Pat. No. 4,617,917; U.S. Pat. No. 4,417,262; U.S. Pat. No. 4,520,525; U.S. Pat. No. 5,729,858; U.S. Pat. No. 5,163,200; and U.S. Pat. No. Des. 283,847.

While these devices fulfill their respective, particular objectives and requirements, the aforementioned patents do not disclose a new foot scrubbing device. The inventive device includes a foot support assembly including a foot support member having a top wall and a bottom wall, and also including a reservoir disposed between the top wall and the bottom wall with the reservoir being adapted to store soap and water therein; and also includes a band member having ends securely attached to sides of the foot support member and being disposed in the reservoir with the band member extending above the foot support member; and further includes a plurality of bristles being disposed upon the top wall of said foot support member and upon an underside of said band member; and also includes a plurality of fastening members being securely attached to an exterior of the bottom wall and being adapted to removably secure the foot scrubbing device to a surface such as a bathtub.

In these respects, the foot scrubbing device according to the present invention substantially departs from the conventional concepts and designs of the prior art and in so doing provides an apparatus primarily developed for the purpose of scrubbing and cleaning a user's feet in a bathtub or shower stall.

SUMMARY OF THE INVENTION

In view of the foregoing disadvantages inherent in the known types of foot cleaner now present in the prior art, the present invention provides a new foot scrubbing device construction wherein the same can be utilized for scrubbing and cleaning a user's feet in a bathtub or shower stall.

The general purpose of the present invention, which will be described subsequently in greater detail, is to provide a new foot scrubbing device which has many of the advantages of the foot cleaner mentioned heretofore and many novel features that result in a new foot scrubbing device which is not anticipated, rendered obvious, suggested, or even implied by any of the prior art foot cleaner, either alone or in any combination thereof.

To attain this, the present invention generally comprises a foot support assembly including a foot support member having a top wall and a bottom wall, and also including a reservoir disposed between the top wall and the bottom wall with the reservoir being adapted to store soap and water therein; and also includes a band member having ends securely attached to sides of the foot support member and being disposed in the reservoir with the band member extending above the foot support member; and further includes a plurality of bristles being disposed upon the top wall of said foot support member and upon an underside of said band member; and also includes a plurality of fastening members being securely attached to an exterior of the bottom wall and being adapted to removably secure the foot scrubbing device to a surface such as a bathtub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot scrubbing device which has many of the advantages of the foot cleaner mentioned heretofore and many novel features that result in a new foot scrubbing device which is not anticipated, rendered obvious, suggested, or even implied by any of the prior art foot cleaner, either alone or in any combination thereof.

It is another object of the present invention to provide a new foot scrubbing device which may be easily and efficiently manufactured and marketed.

It is a further object of the present invention to provide a new foot scrubbing device which is of a durable and reliable construction.

An even further object of the present invention is to provide a new foot scrubbing device which is susceptible of a low cost of manufacture with regard to both materials and labor, and which accordingly is then susceptible of low prices of sale to the consuming public, thereby making such foot scrubbing device economically available to the buying public.

Still yet another object of the present invention is to provide a new foot scrubbing device which provides in the apparatuses and methods of the prior art some of the advantages thereof, while simultaneously overcoming some of the disadvantages normally associated therewith.

Still another object of the present invention is to provide a new foot scrubbing device for scrubbing and cleaning a user's feet in a bathtub or shower stall.

Yet another object of the present invention is to provide a new foot scrubbing device which includes a foot support assembly including a foot support member having a top wall and a bottom wall, and also including a reservoir disposed between the top wall and the bottom wall with the reservoir being adapted to store soap and water therein; and also includes a band member having ends securely attached to sides of the foot support member and being disposed in the reservoir with the band member extending above the foot support member; and further includes a plurality of bristles being disposed upon the top wall of said foot support member and upon an underside of said band member; and also includes a plurality of fastening members being securely attached to an exterior of the bottom wall and being adapted to removably secure the foot scrubbing device to a surface such as a bathtub.

Still yet another object of the present invention is to provide a new foot scrubbing device that is ideally suited to users having back problems who aren't able to stoop over to effectively cleans one's feet.

Even still another object of the present invention is to provide a new foot scrubbing device that effectively eliminates the use of hand-brushes and is easy and conveniently to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
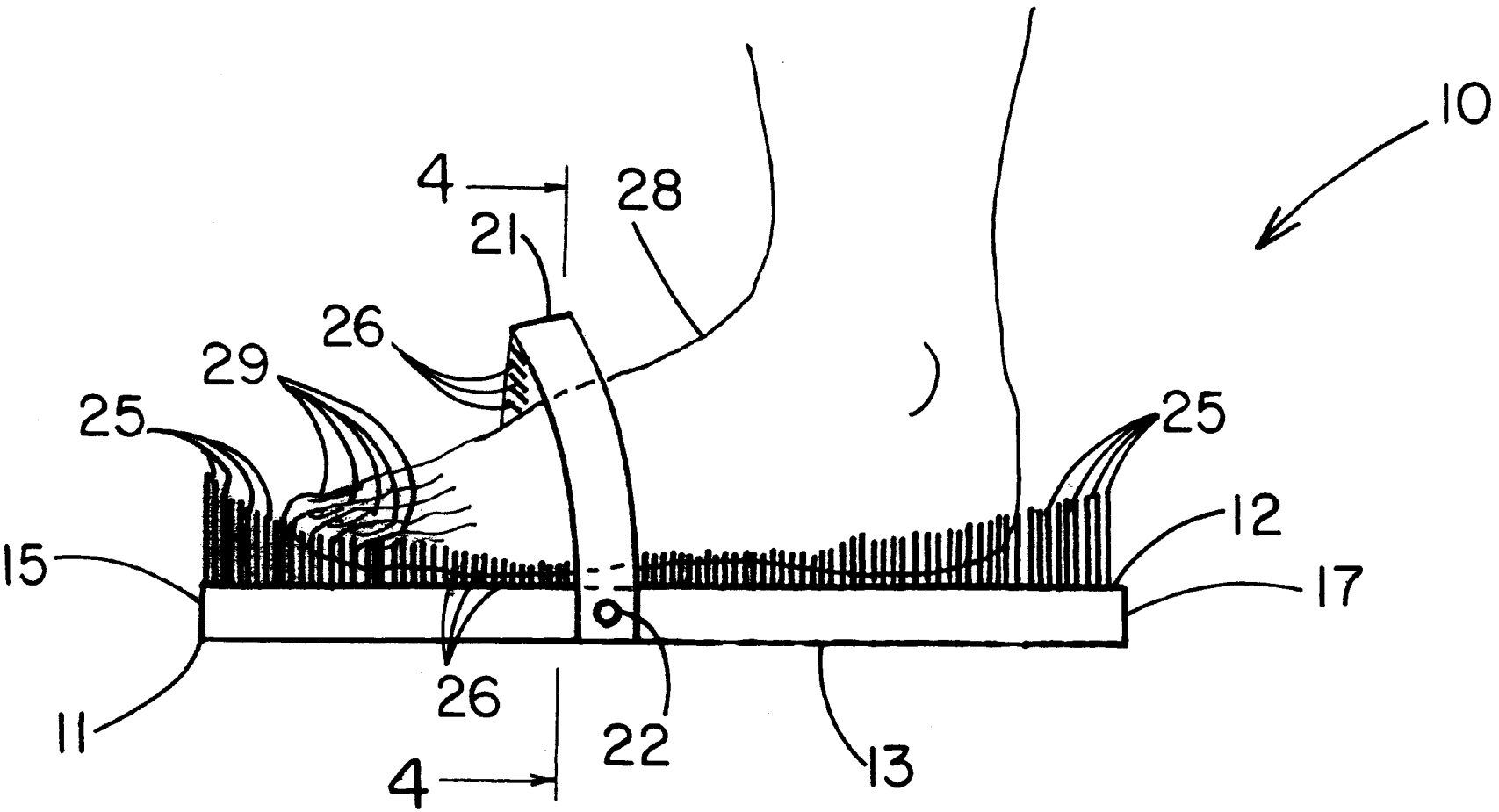
FIG. 1 is a side elevational view of a new foot scrubbing device according to the present invention.
Figure 2:
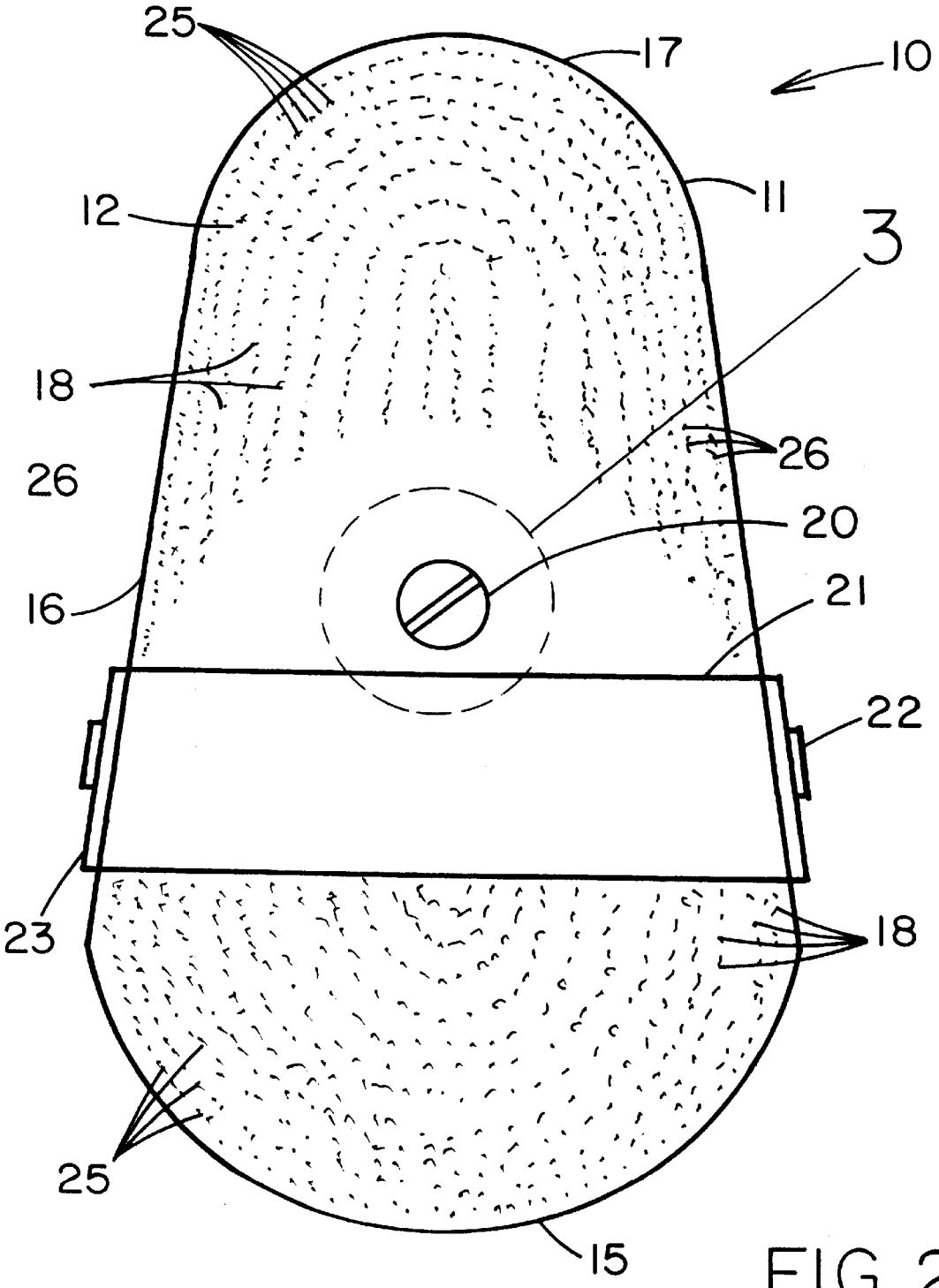
FIG. 2 is a top plan view of the present invention.
Figure 3:
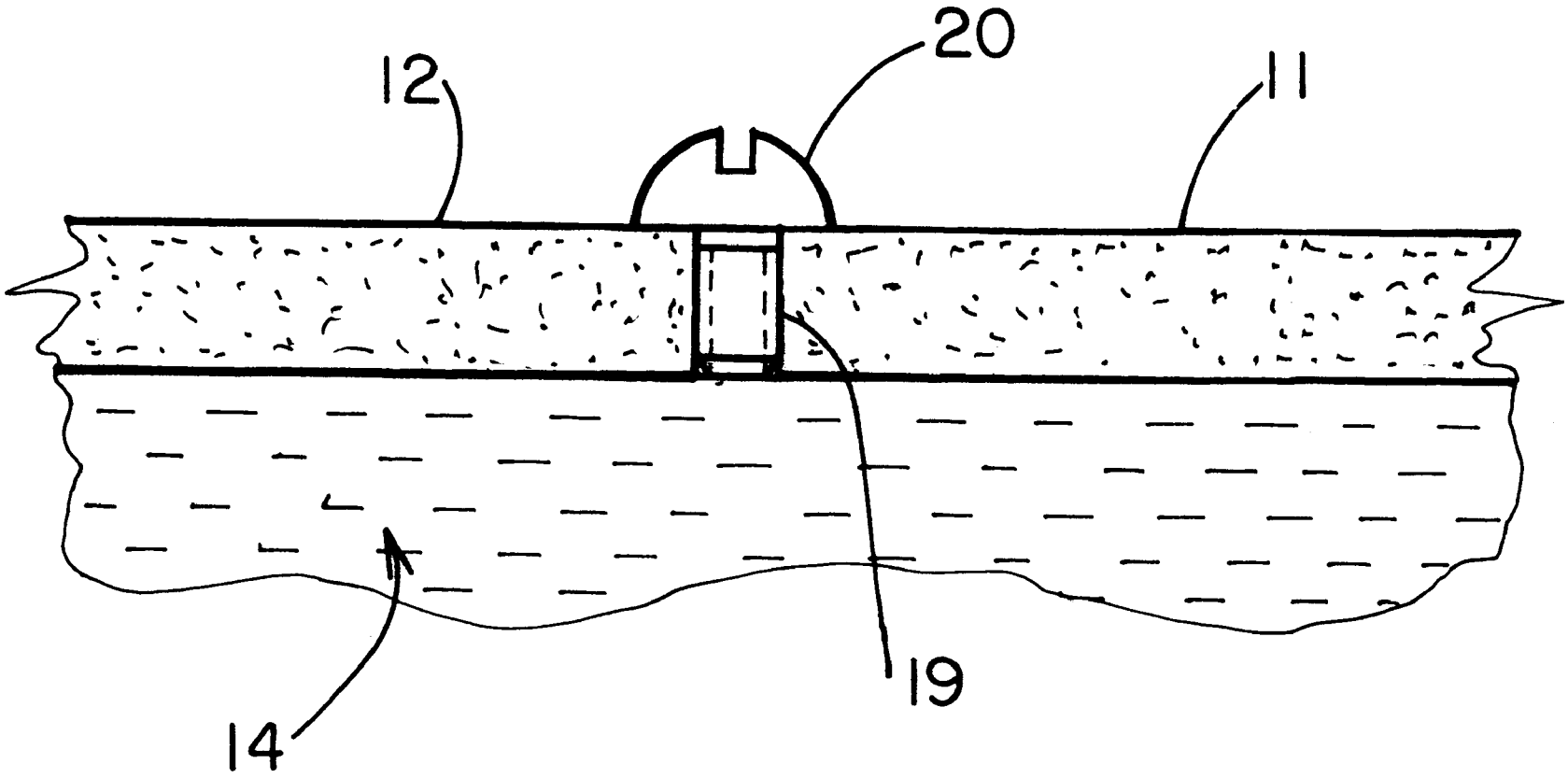
FIG. 3 is a detailed cross-sectional view of the cap member for the reservoir of the present invention.
Figure 4:
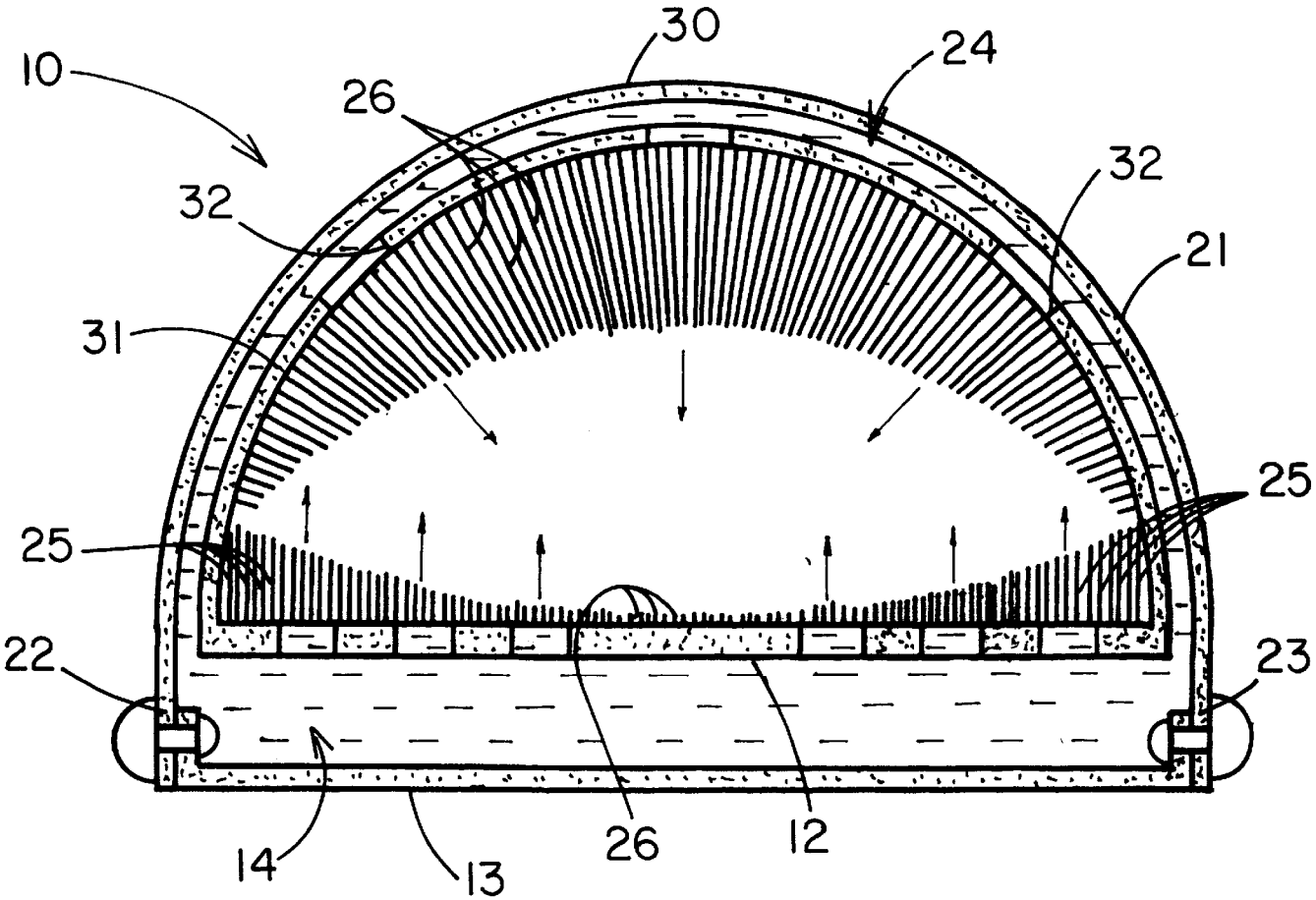
FIG. 4 is a lateral cross-sectional view of the present invention.
Figure 5:
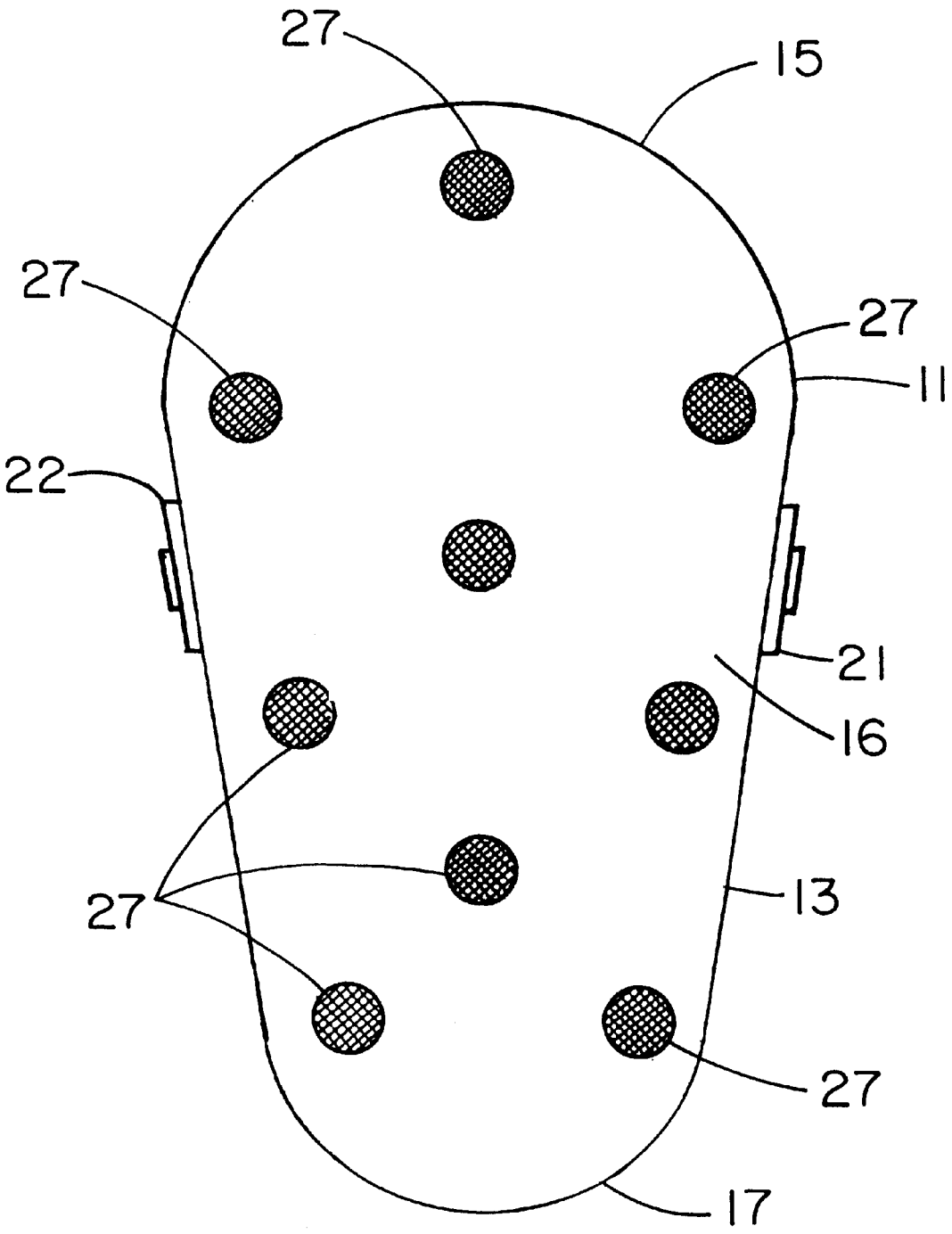
FIG. 5 is a bottom plan view of the present invention.

With reference now to the drawings, and in particular to FIGS. 1 through 5 thereof, a new foot scrubbing device embodying the principles and concepts of the present invention and generally designated by the reference numeral 10 will be described.

As best illustrated in FIGS. 1 through 5, the foot scrubbing device 10 generally comprises a foot support assembly including a squeezable foot support member 11 having a top wall 12 and a bottom wall 13, and also including a reservoir 14 disposed between the top wall 12 and the bottom wall 13. The reservoir 14 is adapted to store soap and water therein. The foot support member 11 is generally foot-shaped and has a front portion 15 and a rear portion 17 which is relatively smaller than the front portion 15. The foot support member 11 is generally tapered from the front portion 15 to the rear portion 17. The foot support member 11 also includes a plurality of first slits 18 being conventionally disposed through the top wall 12 and into the reservoir 14 for allowing the soap and water to be dispensed therethrough. The foot support assembly also including an opening 19 being centrally-disposed through the top wall 12 and into the reservoir 14, and further includes a cap member 20 being removably and conventionally disposed in the opening 19 to essentially close the reservoir 14. The opening 19 is adapted to allow the reservoir 14 to be filled with the soap and water with the foot support member 11 having a length of approximately 10 inches and a width of approximately 3½ to 4½ inches.

A band member 21 has ends 22, 23 conventionally attached to sides of the foot support member 11 and being disposed in the reservoir 14. The band member 21 extends above the foot support member 11. The band member 21 also includes an outer wall 30, an underside wall 31, and a conduit 24 conventionally disposed between the outer wall 30 and the underside wall 31 and being connected to the reservoir 14 for allowing the soap and water to pass therethrough upon the foot support member 11 being squeezed. The band member 21 further includes a plurality of second slits 32 being disposed through the underside wall 31 for allowing the soap and water to be dispensed therethrough.

A plurality of bristles 25, 26 are conventionally disposed upon the top wall 12 of the foot support member 11 and upon an underside of the band member 21. The plurality of bristles 25, 26 includes first bristles 25 which are disposed along and about perimeters of the front and rear portions 15, 17 of the foot support member 11, and also includes second bristles 26 which are disposed about and along a perimeter of a central portion 17 of the foot support member 11 and along and about the underside wall 31 of the band member 21. The first bristles 25 are generally longer than the second bristles 26 to effectively cleans a user's toes 29.

A plurality of fastening members 27 are securely and conventionally attached to an exterior of the bottom wall 13 and are adapted to removably secure the foot scrubbing device 10 to a surface such as a bathtub. The fastening members 27 are suction cup members 27 being spaced about and being securely and conventionally disposed in the exterior of the bottom wall 13 of the foot support member 11 for adhering to a bottom of the bathtub or shower stall.

In use, the foot support member 11 would be adhered to the bottom wall of the bathtub or shower stall, and the user would place one's foot 28 upon the top wall 12 of the foot support member 11 and below the underside wall 31 of the band member 21 and would move one's foot 28 back and forth upon the bristles 25, 26 and would press upon the foot support member 11 to urge soap and water from the reservoir 14 and slits 18, 33 onto the bristles 25, 26 to effectively clean one's foot 28 including toes 29.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot scrubbing device comprising:

a foot support assembly including a squeezable foot support member having a top wall and a bottom wall, and also including a reservoir disposed between said top wall and said bottom wall, said reservoir being adapted to store soap and water therein;

a band member having ends attached to sides of said foot support member and being disposed in said reservoir, said band member extending above said foot support member;

a plurality of bristles being disposed upon said top wall of said foot support member and upon an underside of said band member; and a plurality of fastening members being securely attached to an exterior of said bottom wall and being adapted to removably secure said foot scrubbing device to a surface such as a bathtub.

2. A foot scrubbing device as described in claim 1, wherein said foot support member is generally foot-shaped and has a front portion and a rear portion which is relatively smaller than said front portion, said foot support member being generally tapered from said front portion to said rear portion.

3. A foot scrubbing device as described in claim 2, wherein said foot support member also includes a plurality of first slits disposed through said top wall and into said reservoir for allowing the soap and water to be dispensed therethrough.

4. A foot scrubbing device as described in claim 3, wherein said foot support assembly also includes an opening centrally-disposed through said top wall and into said reservoir, and further includes a cap member being removably disposed in said opening to essentially close said reservoir, said opening being adapted to fill said reservoir with the soap and water.

5. A foot scrubbing device as described in claim 4, wherein said band member also includes an outer wall, an underside wall, and a conduit disposed between said outer wall and said underside wall and being connected to said reservoir for allowing the soap and water to pass therethrough upon said foot support member being squeezed.

6. A foot scrubbing device as described in claim 5, wherein said band member further includes a plurality of second slits being disposed through said underside wall for allowing the soap and water to be dispensed therethrough.

7. A foot scrubbing device as described in claim 6, wherein said plurality of bristles include first bristles which are disposed along and about perimeters of said front and rear portions of said foot support member, and also include second bristles which are disposed about and along a perimeter of a central portion of said foot support member and along and about said underside wall of said band member, said first bristles being generally longer than said second bristles to effectively cleans a user's toes.

8. A foot scrubbing device as described in claim 7, wherein said fastening members are suction cup members being spaced about and being securely disposed in said exterior of said bottom wall of said foot support member for adhering to a bottom of the bathtub or shower stall.

9. A foot scrubbing device comprising:

a foot support assembly including a squeezeable foot support member having a top wall and a bottom wall, and also including a reservoir disposed between said top wall and said bottom wall, said reservoir being adapted to store soap and water therein, said foot support member being generally foot-shaped and has a front portion and a rear portion which is relatively smaller than said front portion, said foot support member being generally tapered from said front portion to said rear portion, said foot support member also including a plurality of first slits disposed through said top wall and into said reservoir for allowing the soap and water to be dispensed therethrough, said foot support assembly also including an opening centrally-disposed through said top wall and into said reservoir, and further including a cap member being removably disposed in said opening to essentially close said reservoir, said opening being adapted to fill said reservoir with the soap and water, said foot support member having a length of approximately 10 inches and a width of approximately 3½ to 4½ inches;

a band member having ends attached to sides of said foot support member and being disposed in said reservoir, said band member extending above said foot support member, said band member also including an outer wall, an underside wall, and a conduit disposed between said outer wall and said underside wall and being connected to said reservoir for allowing the soap and water to pass therethrough upon said foot support member being squeezed, said band member further including a plurality of second slits being disposed through said underside wall for allowing the soap and water to be dispensed therethrough;

a plurality of bristles being disposed upon said top wall of said foot support member and upon an underside of said band member, said plurality of bristles including first bristles which are disposed along and about perimeters of said front and rear portions of said foot support member, and also including second bristles which are disposed about and along a perimeter of a central portion of said foot support member and along and about said underside wall of said band member, said first bristles being generally longer than said second bristles to effectively cleans a user's toes; and a plurality of fastening members being securely attached to an exterior of said bottom wall and being adapted to removably secure said foot scrubbing device to a surface such as a bathtub, said fastening members being suction cup members being spaced about and being securely disposed in said exterior of said bottom wall of said foot support member for adhering to a bottom of the bathtub or shower stall.

* * * * *